US008708781B2

(12) United States Patent
Hamilton

(10) Patent No.: US 8,708,781 B2
(45) Date of Patent: Apr. 29, 2014

(54) SYSTEMS AND METHODS FOR GRINDING REFRACTORY METALS AND REFRACTORY METAL ALLOYS

(75) Inventor: Michael L. Hamilton, San Angelo, TX (US)

(73) Assignee: Ethicon, Inc., Somerville, NJ (US)

( * ) Notice: Subject to any disclaimer, the term of this patent is extended or adjusted under 35 U.S.C. 154(b) by 359 days.

(21) Appl. No.: 12/960,518

(22) Filed: Dec. 5, 2010

(65) Prior Publication Data

US 2012/0142259 A1 Jun. 7, 2012

(51) Int. Cl.
*B24D 3/28* (2006.01)
*B24B 19/16* (2006.01)

(52) U.S. Cl.
CPC ..... *B24B 19/16* (2013.01)
USPC ..... 451/178; 451/541; 451/547; 451/449; 451/488

(58) Field of Classification Search
CPC ..... B24D 3/28; B24D 11/001; B24D 13/142; B24B 19/16; B24B 29/08
USPC ..... 451/57, 58, 65, 539–549, 259, 53, 44, 451/48, 449, 488
See application file for complete search history.

(56) References Cited

U.S. PATENT DOCUMENTS

| | | | | | |
|---|---|---|---|---|---|
| 897,603 | A | * | 9/1908 | Duncan | 451/456 |
| 1,403,416 | A | * | 1/1922 | Katzenstein | 451/541 |
| 1,955,572 | A | * | 4/1934 | Adler et al. | 428/143 |
| 2,081,843 | A | * | 5/1937 | Webster | 451/541 |
| 2,186,001 | A | * | 1/1940 | Bartling | 451/539 |
| 2,268,599 | A | * | 1/1942 | Kinney et al. | 451/541 |
| 2,511,700 | A | * | 6/1950 | Duester | 451/55 |
| 2,797,533 | A | * | 7/1957 | Bluemink | 451/226 |
| 2,869,288 | A | * | 1/1959 | Bretscher | 451/65 |
| 3,022,612 | A | * | 2/1962 | Aoyagi | 451/432 |
| 3,156,077 | A | * | 11/1964 | Connoy et al. | 451/541 |
| 3,436,870 | A | * | 4/1969 | Sellman | 451/540 |
| 3,547,350 | A | * | 12/1970 | Marcoux | 239/308 |
| 3,787,273 | A | * | 1/1974 | Okrepkie et al. | 428/56 |

(Continued)

FOREIGN PATENT DOCUMENTS

| | | | | | |
|---|---|---|---|---|---|
| JP | 52052295 | A | * | 4/1977 | B24D 3/34 |
| JP | 54129589 | A | * | 10/1979 | B24D 5/00 |
| WO | 2008075512 | A1 | | 6/2008 | |

OTHER PUBLICATIONS

International Search Report for International application No. PCT/US2011/063032, mailed May 24, 2012, 5 pages.

(Continued)

*Primary Examiner* — George Nguyen
(74) *Attorney, Agent, or Firm* — Doherty & Charney LLC

(57) ABSTRACT

A system for grinding surgical needles made of refractory metal alloys such as tungsten-rhenium alloys includes a rotatable grinding wheel having a grinding surface, a layer of a binding material, such as a nickel binding material layer, overlying the grinding surface, and a plurality of abrasive particles, such as ABN600 abrasive particles, embedded within the binding material layer. The abrasive particles are similarly sized and the binding material layer has a thickness that is about 65% of the size of the similarly sized abrasive particles. The system includes a lubricating device adapted to apply a lubricant to an interface between the grinding surface and distal ends of needle blanks and a rotating element coupled with the rotatable wheel for rotating the grinding surface at about 10,000 surface feet per minute.

19 Claims, 10 Drawing Sheets

(56) References Cited

U.S. PATENT DOCUMENTS

| | | | | | |
|---|---|---|---|---|---|
| 3,894,673 | A | * | 7/1975 | Lowder et al. | 228/124.5 |
| 4,114,322 | A | * | 9/1978 | Greenspan | 451/541 |
| 4,547,998 | A | | 10/1985 | Kajiyama | |
| 4,611,438 | A | * | 9/1986 | Siden | 451/541 |
| 4,908,996 | A | * | 3/1990 | Friedman et al. | 451/43 |
| 4,931,069 | A | * | 6/1990 | Wiand | 51/293 |
| 4,974,373 | A | * | 12/1990 | Kawashima et al. | 51/295 |
| 5,018,276 | A | * | 5/1991 | Asada | 30/347 |
| 5,167,674 | A | | 12/1992 | Ika | |
| 5,168,671 | A | | 12/1992 | Kataoka et al. | |
| 5,363,601 | A | | 11/1994 | Baltazar et al. | |
| 5,364,422 | A | | 11/1994 | Kitajima et al. | |
| 5,389,118 | A | | 2/1995 | Hinterman et al. | |
| 5,398,455 | A | * | 3/1995 | Slavin et al. | 451/540 |
| 5,415,707 | A | | 5/1995 | Bendel et al. | |
| 5,520,574 | A | * | 5/1996 | Wilson | 451/540 |
| 5,539,973 | A | | 7/1996 | Smith et al. | |
| 5,541,144 | A | | 7/1996 | Wildenburg | |
| 5,542,876 | A | * | 8/1996 | Field, Jr. | 451/540 |
| 5,571,042 | A | * | 11/1996 | Abbate et al. | 451/59 |
| 5,630,268 | A | | 5/1997 | Smith et al. | |
| 5,644,834 | A | | 7/1997 | Smith et al. | |
| 5,651,729 | A | * | 7/1997 | Benguerel | 451/541 |
| 5,661,893 | A | | 9/1997 | Smith et al. | |
| 5,701,656 | A | | 12/1997 | Smith et al. | |
| 5,702,294 | A | | 12/1997 | Baltazar et al. | |
| 5,776,268 | A | | 7/1998 | McJames et al. | |
| 5,810,645 | A | | 9/1998 | Abbate et al. | |
| 6,015,338 | A | | 1/2000 | Hong et al. | |
| 6,018,860 | A | | 2/2000 | Smith et al. | |
| 6,086,467 | A | * | 7/2000 | Imai et al. | 451/541 |
| 6,123,606 | A | * | 9/2000 | Hill et al. | 451/53 |
| 6,123,612 | A | * | 9/2000 | Goers | 451/540 |
| 6,319,108 | B1 | * | 11/2001 | Adefris et al. | 451/533 |
| 6,361,408 | B1 | * | 3/2002 | Bleier | 451/45 |
| 6,629,884 | B1 | * | 10/2003 | Goers | 451/540 |
| 6,769,975 | B2 | * | 8/2004 | Sagawa | 451/541 |
| 6,945,857 | B1 | * | 9/2005 | Doan et al. | 451/56 |
| 7,153,189 | B2 | * | 12/2006 | Morita et al. | 451/7 |
| 7,731,832 | B2 | | 6/2010 | Yamaguchi | |
| 8,308,532 | B2 | * | 11/2012 | Usui et al. | 451/533 |
| 2002/0026752 | A1 | * | 3/2002 | Culler et al. | 51/298 |
| 2004/0043716 | A1 | * | 3/2004 | Takemura et al. | 451/541 |
| 2004/0198206 | A1 | * | 10/2004 | Toge et al. | 451/547 |
| 2005/0048879 | A1 | * | 3/2005 | Skeem et al. | 451/56 |
| 2007/0175765 | A1 | * | 8/2007 | George | 205/158 |
| 2008/0026967 | A1 | | 1/2008 | Suda et al. | |
| 2008/0147117 | A1 | | 6/2008 | Cichocki et al. | |
| 2008/0147118 | A1 | | 6/2008 | Cichocki | |
| 2008/0295927 | A1 | | 12/2008 | Cichocki et al. | |
| 2008/0300552 | A1 | | 12/2008 | Cichocki et al. | |
| 2008/0318820 | A1 | | 12/2008 | Suda et al. | |
| 2009/0151823 | A1 | | 6/2009 | Cichocki et al. | |
| 2009/0157116 | A1 | | 6/2009 | Cichocki et al. | |
| 2009/0157117 | A1 | | 6/2009 | Reynolds et al. | |
| 2009/0234385 | A1 | | 9/2009 | Cichocki et al. | |
| 2009/0312720 | A1 | | 12/2009 | Maurer | |
| 2010/0003904 | A1 | | 1/2010 | Duescher | |
| 2010/0112920 | A1 | * | 5/2010 | Usui et al. | 451/539 |
| 2011/0021122 | A1 | * | 1/2011 | MacKay | 451/539 |
| 2011/0143638 | A1 | * | 6/2011 | Boutaghou | 451/28 |
| 2012/0220208 | A1 | * | 8/2012 | Sung | 451/540 |

OTHER PUBLICATIONS

Marinescu et al., Handbook of Machining with Grinding Wheels, 2006, 10 pages, CRC Press, Toledo, OH.

Marinescu et al., Tribology of Abrasive Machining Processes, 2004, 6 pages, William Andrew, Inc., Norwich, NY.

CBN Abrasive Particles, www.e6.com, 2013, 4 pages, Element Six Ltd., Shannon, County Clare, Ireland.

* cited by examiner

| ABRASIVE MATERIAL | THICKNESS OF BINDING MATERIAL | LUBRICATION USED | NEEDLES TO FAILURE |
|---|---|---|---|
| CBN 2 Wheels | 50% | NO | 500 |
| CBN 3 Wheels | 50% | NO | 1,000 |
| CBN | 50% | YES ~ Inter. Misting | 4,000 |
| CBN Belt | 50% | NO | 5,000 |
| DIAMOND | 50% | NO | 8,000 |
| ABN300 | 50% | YES | 12,000 |
| BZN | 50% | YES | 20,000 |
| ABN600 | 50% | YES | 38,000 |
| ABN600 | 65% | YES | 73,000 |

FIG. 9

SYSTEMS AND METHODS FOR GRINDING REFRACTORY METALS AND REFRACTORY METAL ALLOYS

BACKGROUND OF THE INVENTION

1. Field of the Invention

The present application is generally related to grinding metals and is more specifically related to systems and methods used for grinding refractory metals and refractory metal alloys.

2. Description of the Related Art

Surgical suture needles are commonly made using grinding systems having abrasive particles adapted to grind the distal ends of needle blanks into tapered points. Conventional surgical suture needles are generally fabricated from needle blanks made from non-refractory metals. Examples of non-refractory metals include stainless steel alloys such as 300 series stainless steels, and 420, 420F and 455 stainless steels.

Recently, in order to improve the strength of surgical needles, refractory metal alloys have been used in place of non-refractory metals. One preferred refractory metal alloy is a tungsten-rhenium alloy. Unfortunately, conventional grinding systems that are sufficient for grinding non-refractory metals do not work particularly well for grinding refractory metal alloys. This requires grinding wheels to be continuously replaced which adds expense and variability to the final product that is produced and which slows down the manufacturing process.

One desirable characteristic of a good grinding system includes providing a grinding wheel having a long grinding life, typically useful for grinding at least 50,000 needles. However, when conventional grinding systems are applied to needles made from refractory metal alloys such as tungsten-rhenium alloys, it has been observed that grinding wheel life is extremely short (e.g., 500-8,000 needles).

Grinding wheel failure may be due to "gumming" and/or "capping" of the abrasive material, whereby the material being ground coats the abrasive particles thereby diminishing the ability of the abrasive particles to cut the workpiece. Adding a lubricant to the grinding process has been found to reduce "gumming" and/or "capping," which increases the life of a grinding system. However, this method introduces a new failure mode, commonly referred to as abrasive breakdown or abrasive pull-out, which leads to decreased wheel life and is a major challenge when grinding metals.

The binding material used for binding abrasive particles to a grinding tool, such as a grinding wheel, typically has a thickness that is about 50% of the average size of the abrasive particles. It is conventionally accepted by those skilled in the art that increasing the thickness of the binding material layer above 50% of the size of the abrasive particles will decrease the life of a grinding wheel due to there being less space available between the abrasive particles to accommodate the ground-off portions of the needle. Therefore, increasing the thickness of the binding material layer above 50% of the average size of the abrasive particles has been avoided by those skilled in the art.

In spite of the above advances, there remains a need for improved systems, devices and methods for more economically and efficiently grinding metal objects, such as surgical needles, made from refractory metals and refractory metal alloys.

SUMMARY OF THE INVENTION

In one embodiment, a grinding tool for grinding surgical needles made of refractory metal alloys desirably includes a substrate having a surface, a layer of a binding material overlying the surface, and a plurality of abrasive particles embedded within the binding material layer, whereby the abrasive particles are similarly sized and the binding material layer has a thickness that is about 65% of the size of the similarly sized abrasive particles. As used herein, the terminology "similarly sized" means that substantially all or all of the abrasive particles embedded within the layer of binding material have substantially the same size.

In one embodiment, the size of the abrasive particles is preferably determined using the international sieving guidelines established by either the Federation of European Producers of Abrasive Products (FEPA) and/or the American National Standards Institute (ANSI) for sizing particles. In one embodiment, the abrasive particles may be sized using a shadow graph and then taking the longest dimension across each individual particle as determined by the shadow that is made by each particle. The abrasive particles are preferably grouped by size so that all of the particles used on a grinding tool have the same size or substantially the same size.

In one embodiment, the substrate is desirably made of metal, such as stainless steel. The substrate may be a grinding wheel having an outer edge including the surface. In one embodiment, the outer edge preferably has a V-shaped groove adapted to receive the ends of surgical needle blanks for grinding the needle blanks to tapered points.

In one embodiment, the abrasive particles may have a size that falls within the range of about 20-44 microns, however, all of the abrasive particles used on any single grinding tool are substantially the same size. For example, in one embodiment, the abrasive particles have a similar size of about 44 microns. In one embodiment, all of the abrasive particles are similarly sized and have a size of about 20 microns. In one embodiment, a first grinding tool has similarly sized abrasive particles that have a size of about 44 microns and a second grinding tool has similarly sized abrasive particles that have a size of about 20 microns. The abrasive particles may be ABN600 abrasive particles, such as those sold by Engis Corporation of Wheeling, Ill., or those sold by Element Six Ltd., of County Clare, Ireland. The binding material layer is desirably a nickel alloy that is plated onto a surface of a grinding tool substrate, and the abrasive particles are embedded in the nickel alloy layer so that they project from the nickel alloy layer.

In one embodiment, a rotatable grinding wheel for grinding surgical needles made of refractory metal alloys preferably includes a rotatable wheel having a grinding surface, a nickel binding layer overlying the grinding surface, and a plurality of abrasive particles embedded within the nickel binding layer. The abrasive particles are desirably similarly sized and the nickel binding layer has a thickness that is about 65% of the size of the similarly sized abrasive particles. The grinding surface may have a V-shaped groove extending around an outer edge of the rotatable wheel.

The surgical needles may be made of a tungsten-rhenium alloy. The nickel binding layer preferably includes a nickel alloy, and the abrasive particles may have a size that preferably falls within a range of about 20-44 microns, with all of the abrasive particles on any one grinding tool having about the same size (e.g. all abrasive particles have a thickness of 44 microns).

In one embodiment, the grinding wheel preferably includes a rotating element coupled with the rotatable wheel for rotating the grinding surface at about 10,000 surface feet per minute. The grinding wheel desirably has a lubricator adapted to dispense a lubricant, such as Azolla ZS46 oil, at an interface between the grinding surface and ends of the surgical needles abutted against the grinding surface.

In one embodiment, a system for grinding surgical needles made of refractory metal alloys preferably has a rotatable wheel having a grinding surface, a layer of a binding material overlying the grinding surface, and a plurality of abrasive particles embedded within the binding material layer, whereby the abrasive particles are similarly sized and the binding material layer has a thickness that is about 65% of the size of the similarly sized abrasive particles. The system preferably includes a lubricating device adapted to apply a lubricant to the grinding surface, and a rotating element coupled with the rotatable wheel for rotating the grinding surface.

In one embodiment, the abrasive particles includes ABN600 abrasive particles having an average size that falls within a range of about 20-44 microns and the binding material layer includes a nickel alloy. In one embodiment, the nickel alloy binding material layer is plated onto the grinding surface, and the abrasive particles project from the binding material layer.

Hardness is a critical physical property of an abrasive. ABN600 abrasive particles are one of a class of abrasive particles known as Cubic Boron Nitride Abrasives. ABN600 abrasive particles are black, blocky shaped, high strength abrasive particles having good thermal stability. ABN600 abrasive particles are preferably used in sintered and electroplated metal bonds where the impact loads on the abrasives particles are high, and also in certain other applications where a strong, blocky particle with a relatively negative rake angle is required. ABN600 abrasive particles maintain sharp cutting edges during use while exhibiting high hardness, abrasion resistance, strength and resistance to thermal and chemical breakdown.

In one embodiment, the lubricating device is adapted to direct the lubricant toward an interface between the grinding surface and distal ends of the surgical needles. The lubricant may be Azolla ZS 46 oil. In one embodiment, the rotating element is adapted to rotate the grinding surface of the rotatable wheel at about 10,000 surface feet per minute.

In one preferred embodiment, a grinding wheel has similarly sized ABN600 abrasive particles secured to a grinding surface of the grinding wheel by a nickel alloy binding layer, whereby the binding layer has a thickness that is about 65% of the size of the similarly sized abrasive particles. During a grinding operation, the grinding surface is rotated at 10,000 surface feet per minute and the distal ends of tungsten-rhenium needle blanks are abutted against the grinding surface for forming tapered points at the distal ends. A lubricant is directed toward the interface between the grinding surface and the distal ends of the needle blanks.

In one embodiment, a grinding system includes two or more grinding stations having respective grinding wheels having the features described in the preceding paragraph. At a first grinding station, the first grinding wheel has similarly sized abrasive particles having a size of about 44 microns and the binding material layer has a thickness of 28.6 microns or 65% of the thickness of the abrasive particles. At a second grinding station, the second grinding wheel has similarly sized abrasive particles having a size of about 20 microns and the binding material layer has a thickness of 13.0 microns or 65% of the thickness of the abrasive particles.

These and other preferred embodiments of the present invention will be described in more detail below.

BRIEF DESCRIPTION OF THE DRAWING

FIG. 9 is a chart comparing the number of needles that may be ground by different grinding systems before failure.

DETAILED DESCRIPTION

Figure 1:
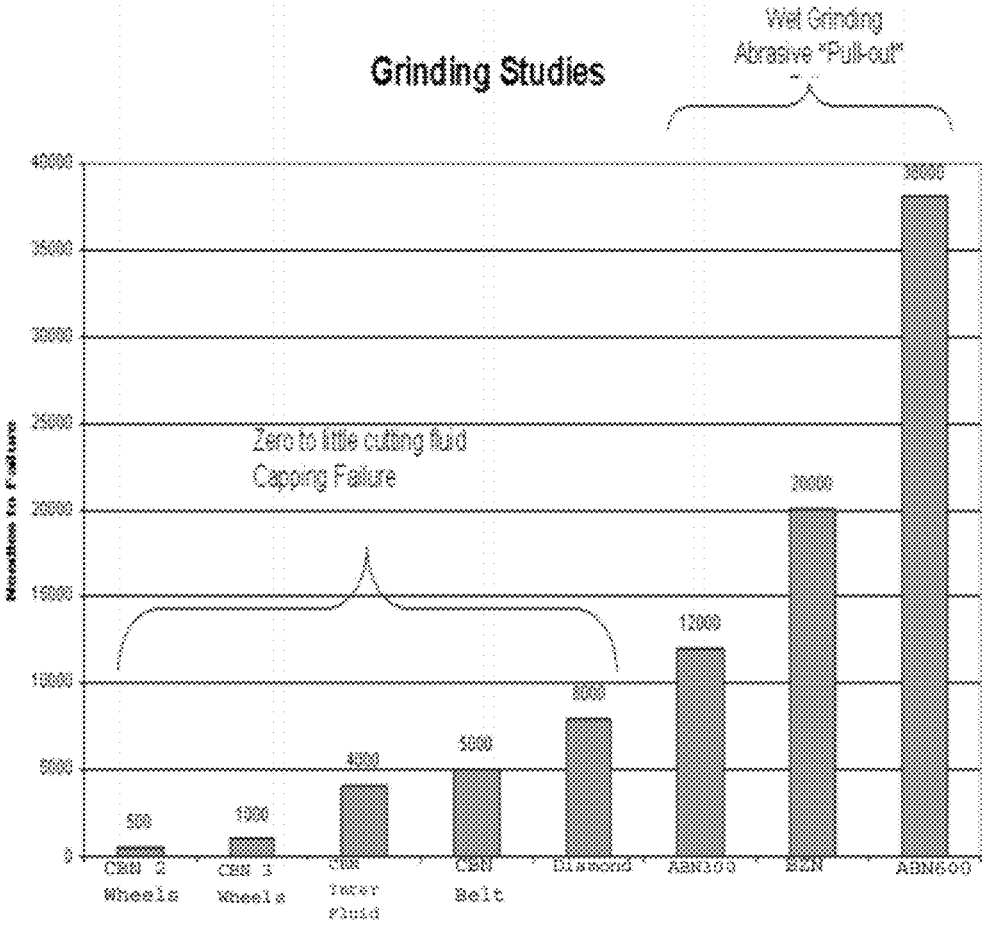
FIG. 1 is a chart showing the results achieved when conventional grinding wheels are used to grind surgical needles made of refractory metal alloys.

Conventional grinding wheels are effective for grinding stainless steel needles, however, it has been observed that they are significantly less effective when grinding surgical needles made of refractory metal alloys such as tungsten-rhenium alloys. Referring to FIG. 1, when grinding wheels or grinding belts having CBN abrasive particles are used to grind refractory metal alloys, with a binding material layer having a thickness that is 50% of the average size of the abrasive particles, and little or no lubricant is used during the grinding process, the grinding wheels or tools typically fail before grinding 10,000 needles. Using lubricant intermittently with a grinding wheel having CBN abrasive particles will increase wheel life from 500 needles before failure to 4,000 needles. In many instances, the grinding wheel failure may be due to "gumming" and/or "capping" of the abrasive particles on the grinding wheel. Using a grinding belt having CBN abrasive particles will increase the grinding tool life to about 5,000 needles. Using a grinding wheel having Diamond abrasive particles will increase the grinding wheel life to about 8,000 needles.

In some instances, a lubricant is used to reduce the occurrence of "gumming" or "capping," which extends the life of a grinding wheel. As used herein, applying a lubricant means that a lubricant is applied in a sufficient quantity that is just short of a quantity or flow that will deflect the ground end of the workpiece. When a grinding wheel has ABN300, BZN, or ABN600 abrasive particles, with a binding material layer having a thickness that is 50% of the size of the abrasive particles, using a lubricant has been found to extend the life of the grinding wheel to between about 10,000-38,000 needles. As shown in FIG. 1, when using a lubricant, grinding wheels with ABN600 abrasive particles delivered the best results and increased wheel life to about 38,000 needles. However, this now shifted the likely cause of failure mode for the grinding wheel to abrasive pull-out.

Figure 2A:
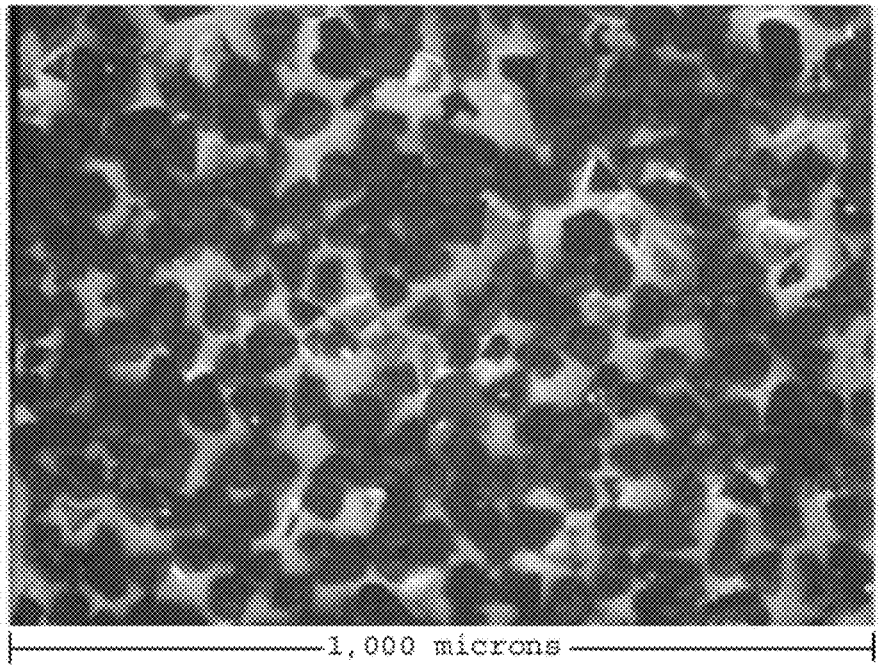
FIG. 2A shows abrasive particles on a grinding surface of a grinding wheel.
Figure 2B:
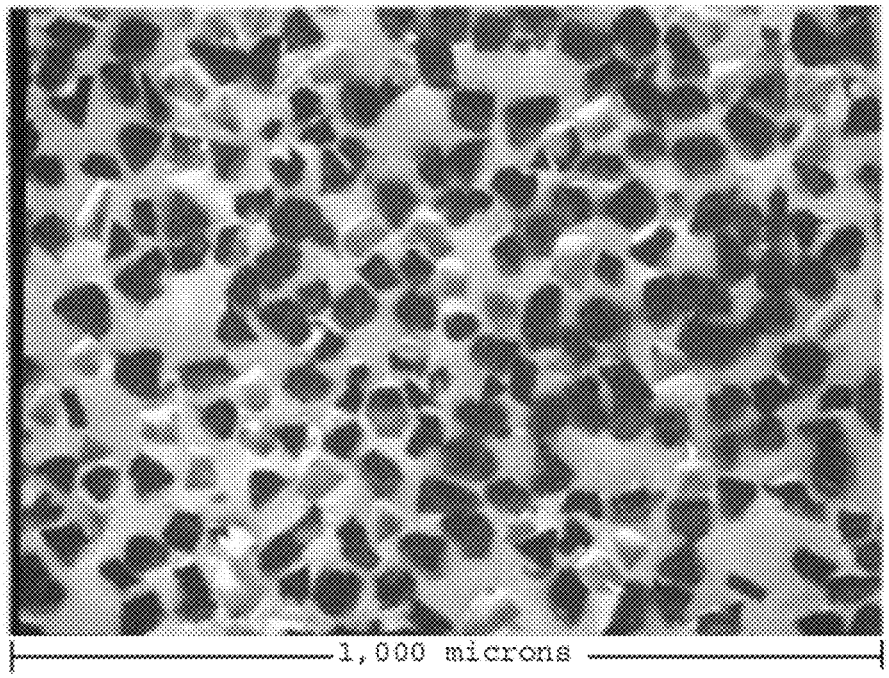
FIG. 2B shows the grinding wheel of FIG. 2A after use with some of the abrasive particles pulled out of a binding material layer.

FIGS. 2A and 2B show the surface of a grinding wheel before and after a grinding process has been conducted. The horizontal dimension shown in FIGS. 2A and 2B is about 1,000 microns. FIG. 2A shows the abrasive particles before a grinding operation has commenced, whereby the abrasive particles are bound to an outer surface of a grinding wheel by a binding material layer. FIG. 2B shows the grinding wheel after use with some of the abrasive particles pulled out of the binding material layer, resulting in a failure event termed "abrasive pull-out." With fewer abrasive particles present, the grinding wheel is less effective at grinding a metal needle blank abutted against the grinding surface.

Figure 3:
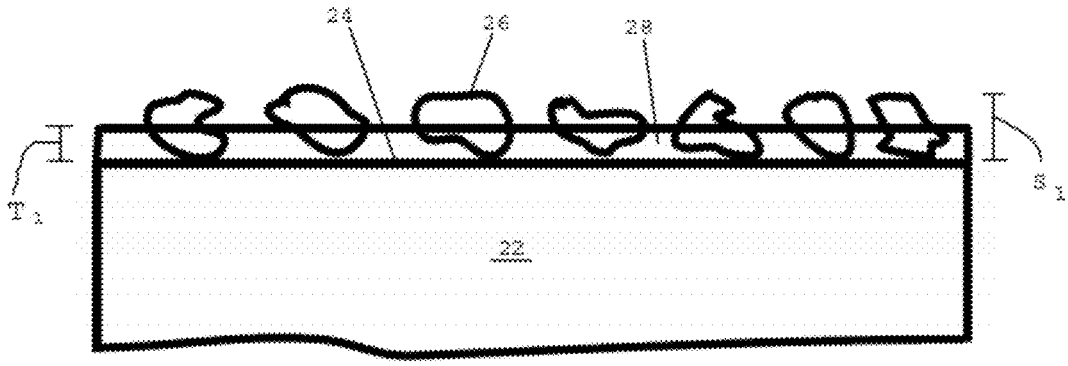
FIG. 3 Prior Art
FIG. 3 shows a cross-sectional view of a surface of a conventional grinding wheel including abrasive particles having an average size and a binding material layer having a thickness that is 50% of the average size of the abrasive particles.

FIG. 3 shows a prior art grinding system 20 including a grinding blank 22, such as a grinding wheel blank, having an outer surface 24. A plurality of abrasive particles 26 are secured to the outer surface 24 of the grinding blank 22 using a binding material layer 28. The binding material layer 28 may be plated onto the outer surface 24 using an electroplating technique. The plurality of abrasive particles 26 are similarly sized and have an average sixe designated $S_1$ with the binding material layer 28 having a thickness $T_1$ that is about 50% of the average size $S_1$ of the abrasive particles 26.

Figure 4A:
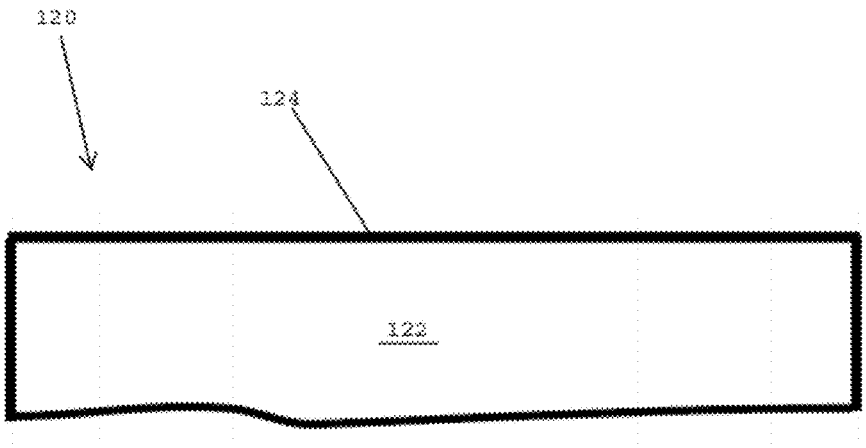
FIGS. 4A-4C show a method of making a grinding wheel whereby the binding material layer has a thickness that is about 65% of the average size of the similarly sized abrasive particles, in accordance with one embodiment of the present invention.
Figure 4B:
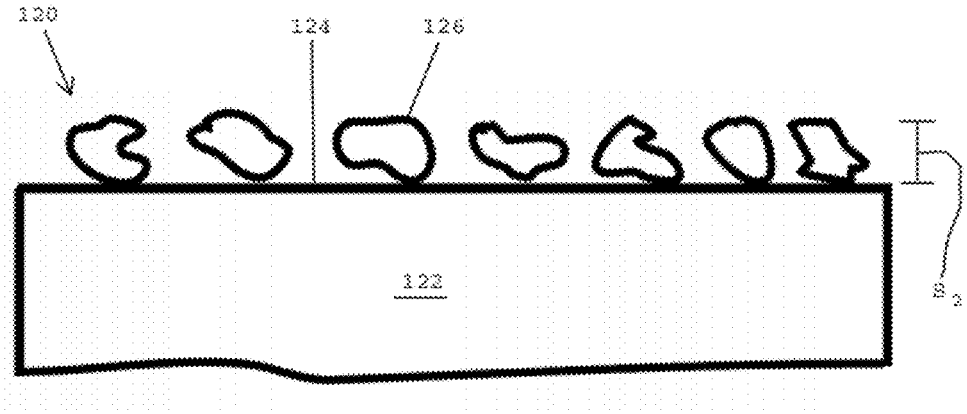
Figure 4C:
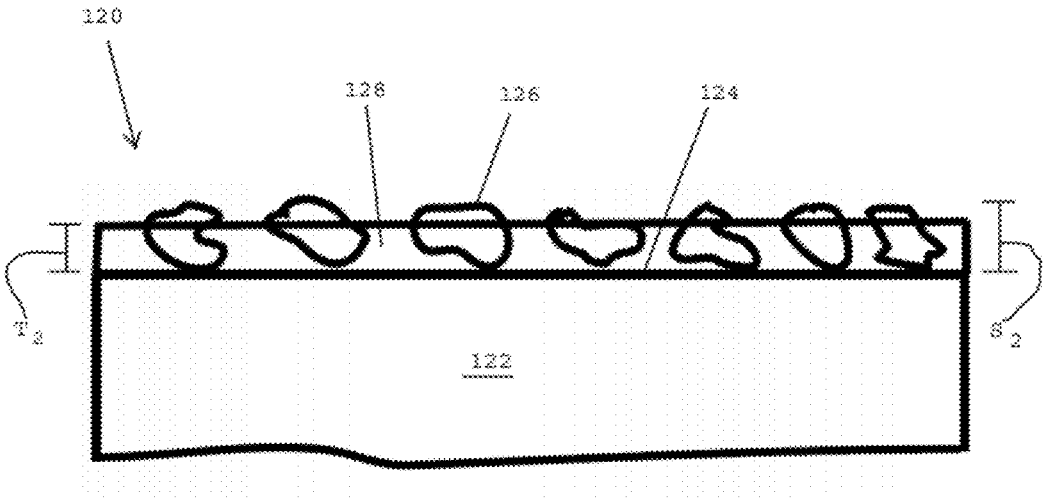

Referring to FIGS. 4A-4C, in one embodiment, a method of making a grinding system 120 for grinding surgical needles made of refractory metal alloys, such as tungsten-rhenium alloys, desirably includes a grinding blank 122, such as a blank for a grinding wheel, having an outer surface 124 adapted to have abrasive particles bound thereto. In one embodiment, the outer surface 124 of the grinding wheel blank 122 defines a grinding surface of the grinding wheel blank 122. The grinding wheel blank 122 may be made of a metal such as stainless steel.

Referring to FIG. 4B, in one embodiment, a plurality of abrasive particles 126 is preferably disposed over the outer surface 124 of the grinding blank 122. In one embodiment, the abrasive particles 126 may be a slurry mixture that is applied over the outer surface 124 of the grinding blank 122. The abrasive particles 126 are preferably similarly sized and have an average size designated $S_2$. In one embodiment, the average size of the similarly sized abrasive particles falls within a range of about 20-44 microns and is more preferably about 44 microns. In one embodiment, a first grinding wheel has similarly sized abrasive particles having an average size of about 44 microns, whereby all of the abrasive particles are the same size (i.e. 44 microns), and a second grinding wheel has similarly sized abrasive particles having an average size that is smaller than the abrasive particles on the first grinding wheel, e.g. all of the abrasive particles have a size of about 20 microns. In one embodiment, the abrasive particles 126 are ABN600 abrasive particles, such as those sold by Engis Corporation of Wheeling, Ill. or Element Six Ltd. of County Clare, Ireland.

Referring to FIG. 4C, in one embodiment, a binding material layer 128 is formed over the outer surface 124 of the grinding wheel blank 122 for binding the abrasive particles 126 to the outer surface of the grinding wheel blank. The binding material layer 128 desirably has a thickness $T_2$ that is about 65% of the average size $S_2$ of the abrasive particles 126. The 65% thickness of the binding material layer relative to the abrasive particle size is about 30% greater than the 50% thickness of the binding material layer relative to the abrasive particle size found on conventional grinding wheels (FIG. 3). In one embodiment, the similarly sized abrasive particles 126 have an average size of 44 microns, and the binding material layer has a thickness of about 28.6 microns, which is 65% of the size of the abrasive particles. In one embodiment, the similarly sized abrasive particles have a size of about 20 microns, and the binding material layer has a thickness of about 13.0 microns, which is 65% of the size of the abrasive particles. In one embodiment, the binding material layer is plated onto the outer surface of the blank, such as by using an electroplating technique. In one embodiment, the binding material layer 128 is preferably a nickel alloy material.

Conventional grinding wheels use a binding material layer having a thickness that is no more than 50% of the average size of the abrasive particles embedded therein. The prior art discourages the manufacture and use of grinding wheels whereby the thickness of the binding material layer is greater than 50% of the size of the abrasive particles because less surface area of the abrasive particles is exposed. Applicants of the present invention have found that an unexpected result occurs, however, when the thickness of the binding material layer 128 is increased from 50% of the size of the abrasive particles to 65% of the size of the abrasive particles, particularly when using ABN600 abrasive particles and a lubricant. The unexpected result is that the life of the grinding wheel is dramatically increased so that the grinding wheel is able to grind many more surgical needles made of refractory metal alloys before the grinding wheel or grinding tool fails.

Figure 5:
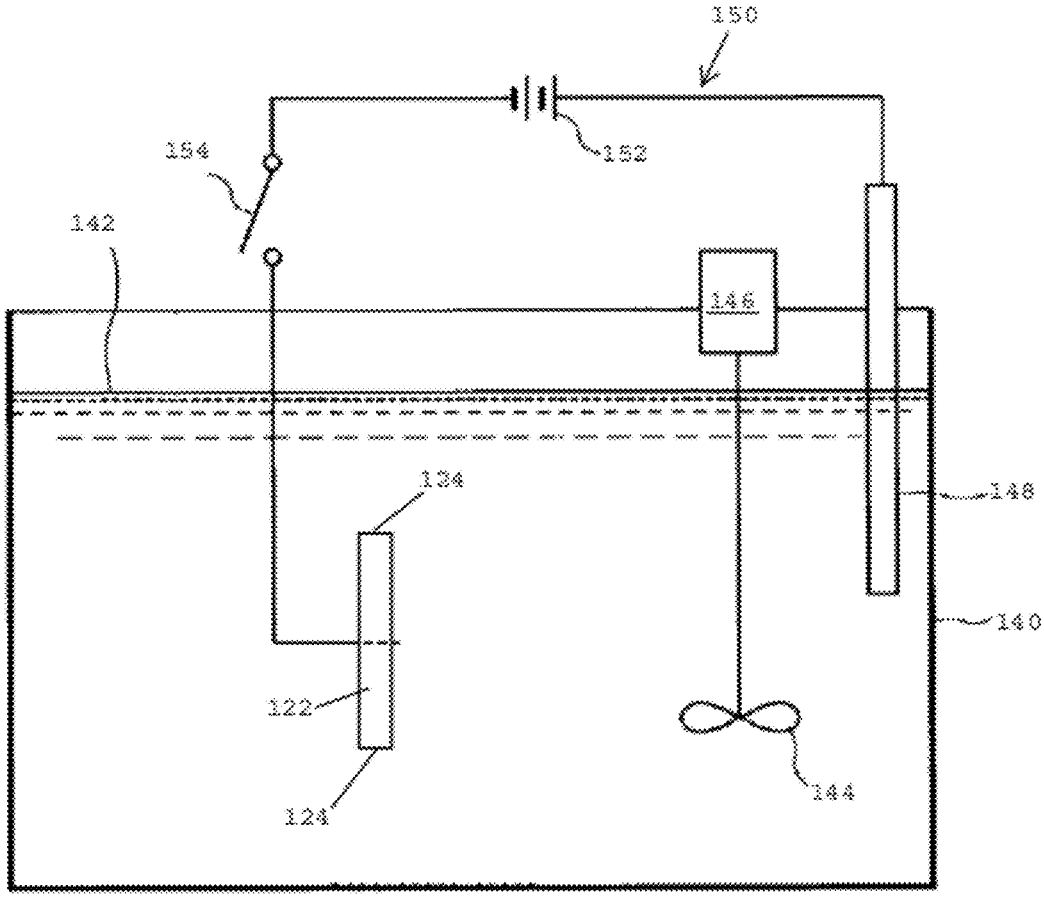
FIG. 5 shows a system for plating a binding material layer on a grinding surface of a grinding wheel, in accordance with one embodiment of the present invention.

Referring to FIG. 5, in one embodiment, a binding material layer is plated onto the grinding wheel blank 122 described above in FIGS. 4A-4C by placing the blank 122 within a plating tank 140 that contains a plating solution 142 such as a nickel sulfate solution. A suitable plating system that may be used is disclosed in U.S. Pat. No. 7,731,832 to Yamaguchi, the disclosure of which is hereby incorporated by reference herein. The plating tank 140 preferably includes a stirring element 144 that is rotationally driven by a drive source 146 such as an electric motor. A metal bar 148, which may be made of nickel, is partly immersed in the plating solution 142. The grinding wheel blank 122, such as a stainless steel grinding wheel blank having the outer surface 124, is immersed in the plating solution 142. Prior to the placement of the grinding wheel blank 122 in the plating tank 140, selected portions of the grinding wheel blank, except for the outer surface 124, are coated with a masking material that prevents the nickel from being plated to the wheel blank 122.

The electroplating system also preferably includes a voltage applicator 150 for applying a direct current voltage between the metal bar 148 and the grinding wheel 122. The voltage applicator 150 preferably includes a direct current voltage source 152 and an On/Off switch 154.

In one embodiment, a plurality of abrasive particles (designated by reference number 126 in FIGS. 4A-4C) is applied over the outer surface 124 of the grinding wheel 122. The abrasive particles are desirably similarly sized. In one embodiment, the abrasive particles are ABN600 abrasive particles having a similar size of about 44 microns. In one embodiment, the abrasive particles are ABN600 abrasive particles having a similar size of about 20 microns. The grinding wheel blank 122 having the abrasive particles 126 applied thereto is preferably lowered within the plating solution 142. The switch 154 is closed so that the nickel from the metal bar 148 may be electroplated onto the outer surface 124 of the grinding wheel 122. Consequently, the abrasive particles are bound to the outer surface 124 of the grinding wheel 122 by the nickel binding layer.

Figure 6A:
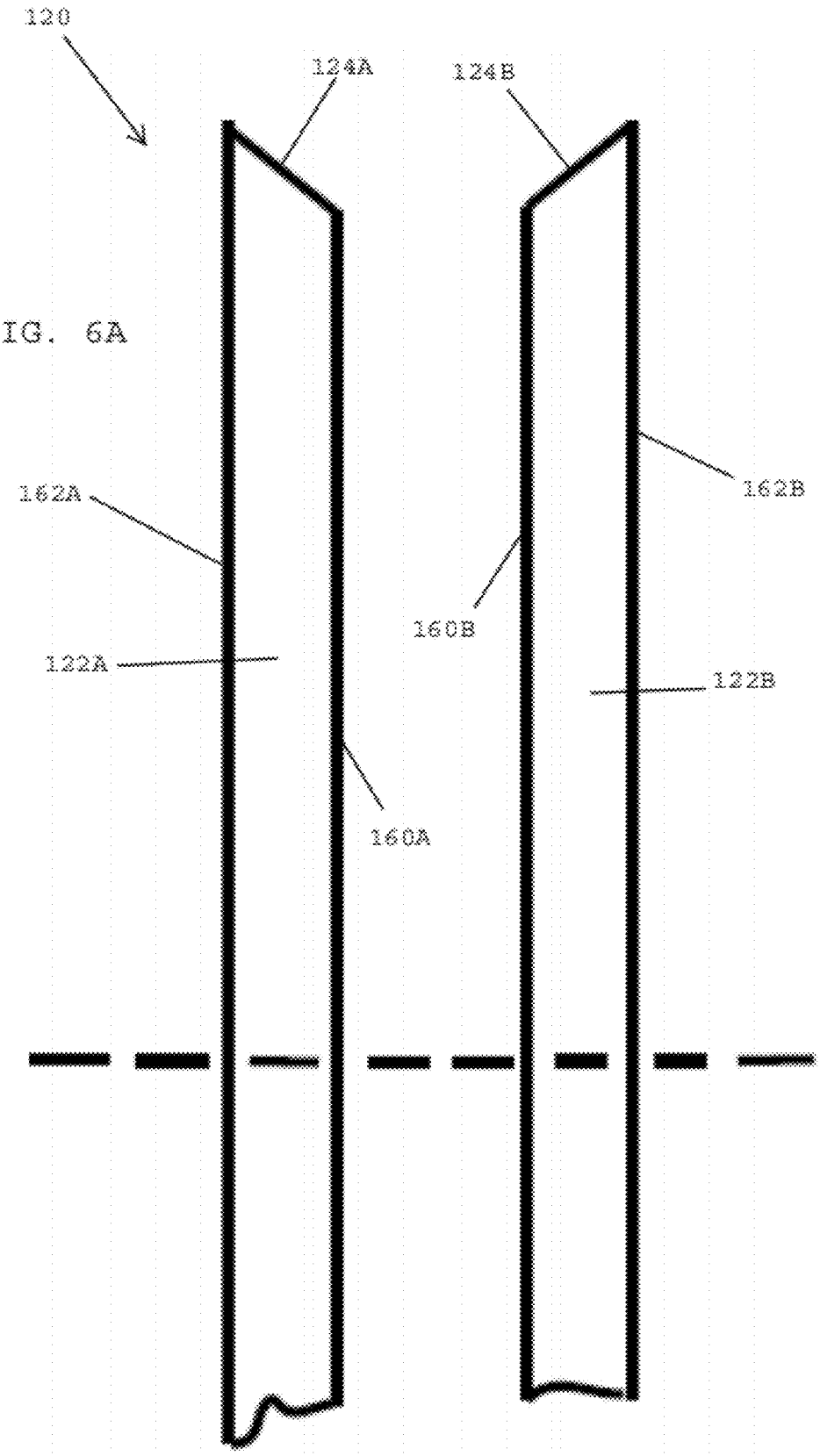
FIGS. 6A-6C show a method of making a grinding wheel, in accordance with one embodiment of the present invention.
Figure 6B:
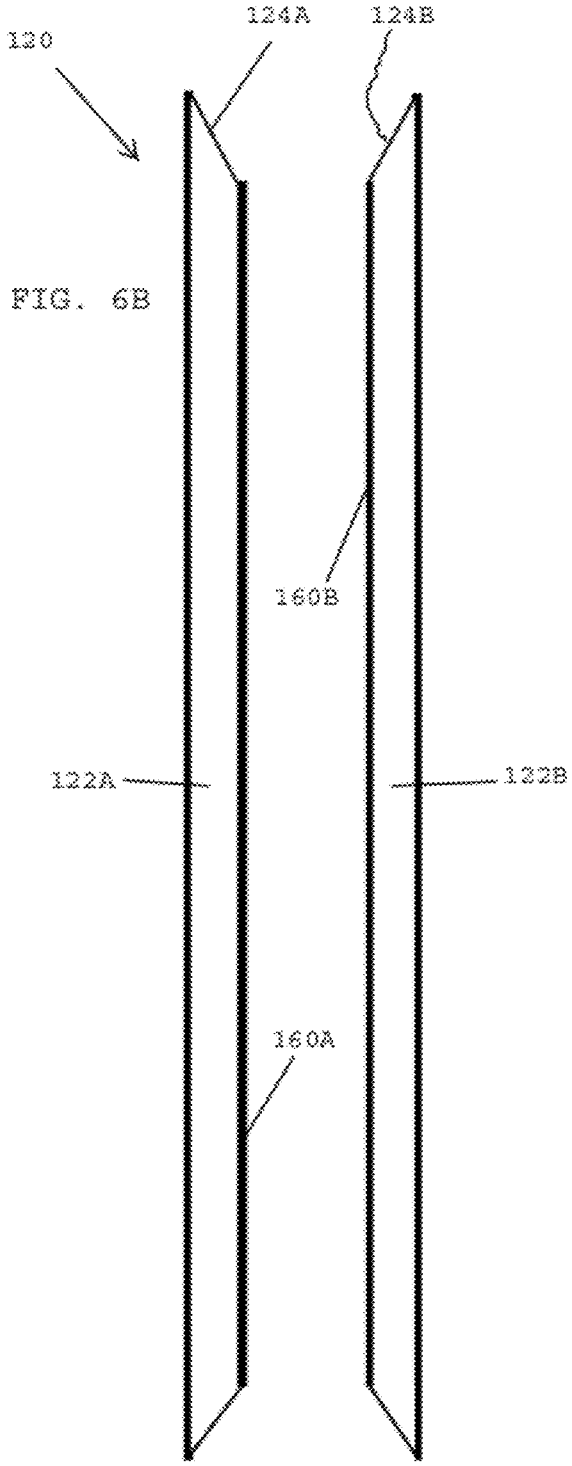
Figure 6C:
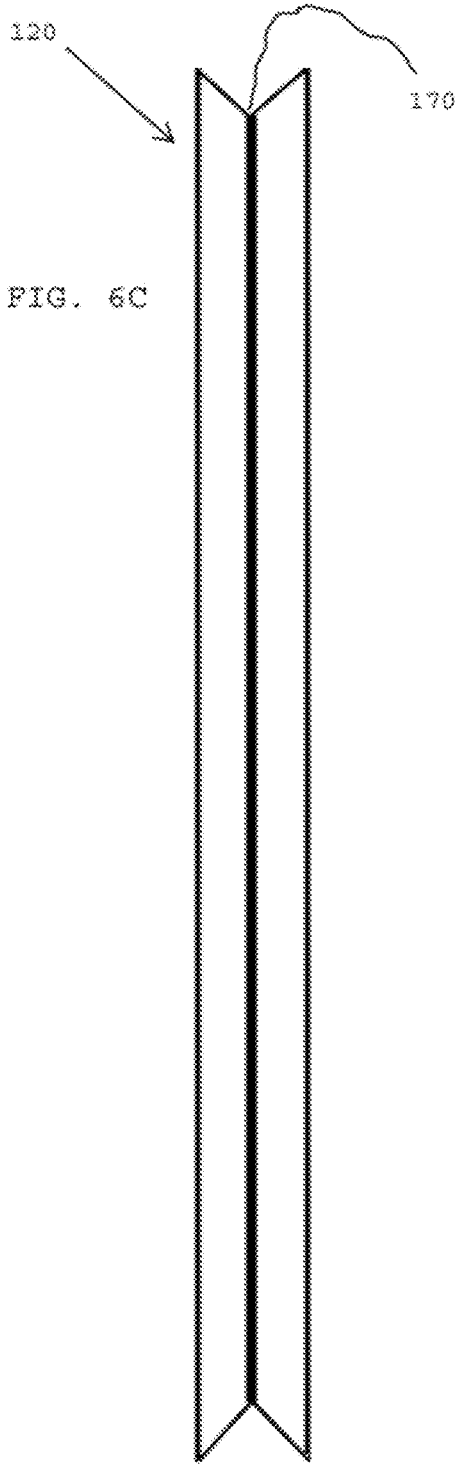

Referring to FIGS. 6A-6C, in one embodiment, a grinding wheel 120 is formed by providing a first blank half 122A and a second blank half 122B that are adapted to be joined together. The first blank half 122A desirably includes an inner face 160A, an outer face 162A and an outer edge surface 124A that slopes downwardly between the outer face 162A and the inner face 160A.

The second blank half 122B desirably includes an inner face 160B, an outer face 162B, and an outer edge surface 124B that slopes downwardly between the outer face 162B and the inner face 160B. In one embodiment, the abrasive particles 126 shown in FIGS. 4B and 4C are deposited over the sloping outer edges 124A, 124B of the respective first and second blank halves 122A, 122B. Selected surfaces of the first and second blank halves, such as the outer faces 162A, 162B, may be covered with a masking material to prevent the binding material layer from attaching thereto.

FIG. 6B shows the first and second blank halves 122A, 122B before the two blank halves are assembled together. In one embodiment, the respective inner faces 160A, 160B oppose one another. The first and second blank halves 122A, 122B are preferably circular in shape so that the sloping outer edges 124A, 124B cooperatively define an annular surface that extends around the outer perimeter of the first and second blank halves 122A, 122B.

Referring to FIG. 6C, the opposing inner faces 160A, 160B may be abutted against one another and secured together for forming a grinding wheel 120 having a V-shaped or grooved grinding surface 170 extending around the outer perimeter of the grinding wheel. In one embodiment, distal ends of surgical needle blanks may be abutted against the V-shaped or grooved grinding surface 170 for grinding the distal ends of the surgical needles. In one embodiment, the V-shaped or grooved grinding surface preferably has a shape that matches the desired contour and/or shape of a surgical needle having a distal pointed tip, such as the surgical needle shown in FIG. 8C of the present application.

Figure 7:
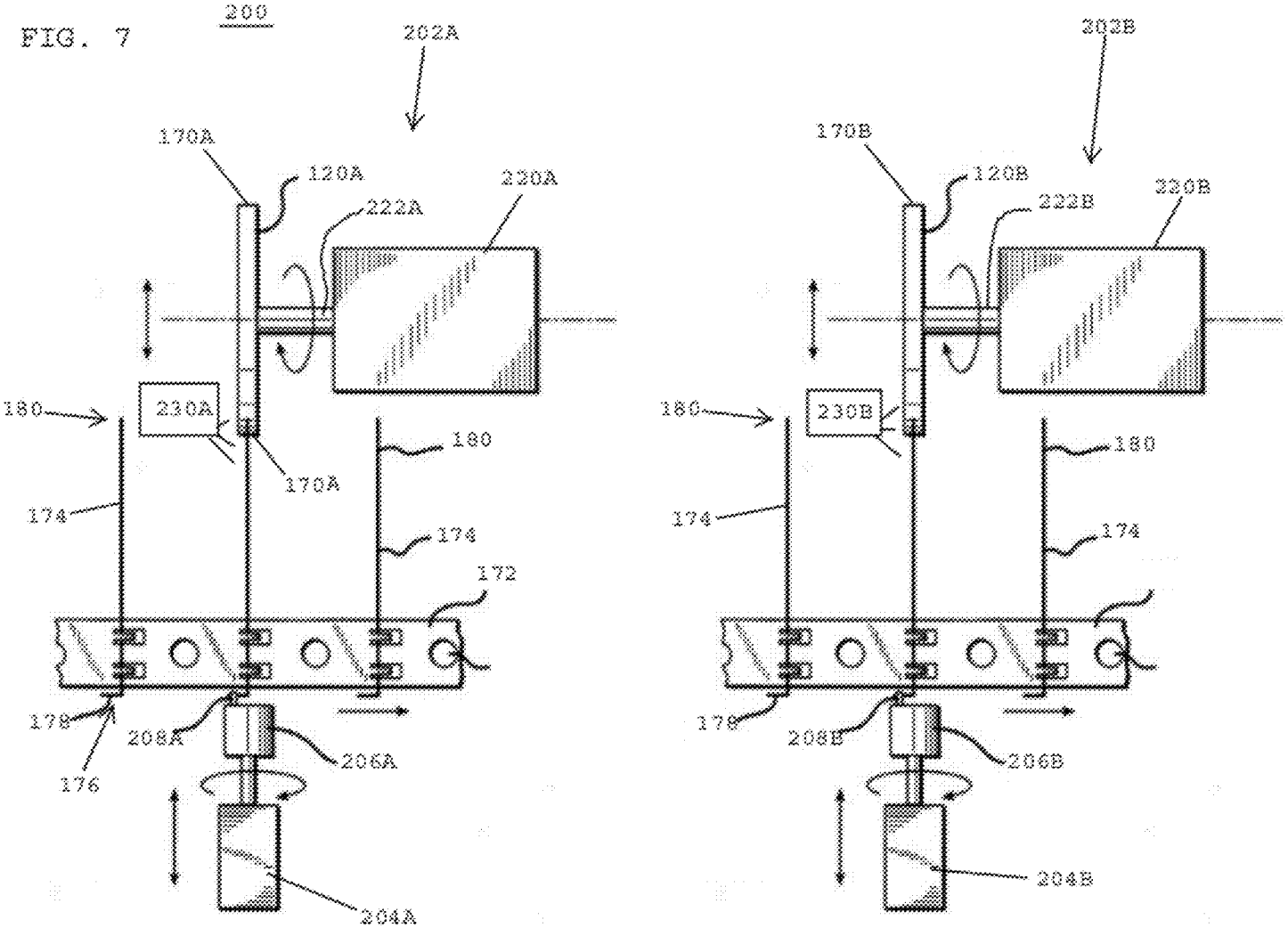
FIG. 7 shows a system for grinding surgical needles, including a first grinding station having abrasive particles having a first average size and a second grinding station having abrasive particles having a second average size, in accordance with one embodiment of the present invention.

Referring to FIG. 7, in one embodiment, a grinding system 200 includes a carrier strip 172 that is used for grinding a plurality of needle blanks 174 having a proximal end 176 with a tail 178 bent at about 90° and a distal end 180 adapted to be abutted against a grinding surface of a rotating grinding wheel. The carrier strip 172 is desirably made of a flexible material such as a metal or a polymer. In one embodiment, the carrier strip 172 has one or more of the features disclosed in commonly assigned U.S. Pat. No. 5,539,973, the disclosure of which is hereby incorporated by reference herein.

The carrier strip 172 is preferably adapted to receive the needle blanks 174. The carrier strip desirably includes mounting tabs 182 that hold the needle blanks 174 to the carrier strip, while enabling the needle blanks 174 to be rotatable about their respective longitudinal axes. In one embodiment, the needle blanks 174 are cut and inserted into the mounting tabs 182 by inserting the spool of wire into each tab 182 and then cutting the wire to form a distinct needle blank. The tabs 182 may be crimped to retain the needle blanks 174 in place.

Referring to FIG. 7, in one embodiment, the grinding system 200 for grinding tapered points on surgical needle preferably includes a first grinding station 202A and a second grinding station 202B. The first grinding station 202A preferably includes a needle blank rotating device 204 adapted to rotate the tail 178 at the proximal end 176 of the surgical needle blank 174. In one embodiment, the needle blank rotating device 204 desirably includes a rotatable disc 206 coupled with the needle blank rotating device 204 and a pin 208 mounted on the rotatable disk 206 that engages the tail 178 for rotating the needle blank 174 about its longitudinal axis within the carrier strip 172.

The first grinding station 202A desirably includes a first grinding wheel 120A having a grinding surface 170A that is rotated by a motor 220A having a shaft 222A. The abrasive grinding surface 170A desirably includes ABN600 abrasive particles that are similarly sized and that have an average size of about 44 microns as determined using FEPA/ANSI standards for measuring particle sizes. The abrasive particles are bound to the grinding surface 170A by a nickel plated binding layer having a thickness of about 65% of the size of the 44 micron abrasive particles. The first grinding station 202A also desirably includes a lubricator 230A adapted to apply a lubricant between the distal ends 180 of the needle blanks 174 and the grinding surface 170A of the first grinding wheel 120A. In one embodiment, the lubricant is applied in a sufficient volume or quantity that is just short of a volume or quantity that will deflect the distal end of the needle away from the grinding surface. In one embodiment, the lubricant is preferably a high-performance, anti-wear, thermally stable lubricating oil such as the lubricant designated Azolla ZS 46 sold by Total Lubricants USA, Inc. of Linden, N.J.

In one embodiment, the motor 220A rotates the grinding wheel 120A and the distal ends 180 of the needle blanks 174 are abutted against the abrasive grinding surface 170A to form tapered points at the distal ends 180. The needle blanks are preferably rotated about their longitudinal axes when being abutted against the grinding surface 170A. Simultaneously, the lubricator 230A dispenses a lubricant onto the interface between the grinding surface 170A and the distal end 180 of the needle blank 174. In one embodiment, the grinding wheel 120A desirably includes a V-shaped grinding surface 170A including abrasive particles bound to the grinding surface by a binding layer. In one embodiment, the abrasive particles at the first grinding station 202A preferably have a size of about 44 microns. The binding material layer preferably has a thickness that is proximally 65% percent of the size of the abrasive particles.

In one embodiment, the grinding system 200 preferably includes a second grinding station 202B having a second needle blank rotating device 204B adapted to rotate a tail 178 at the proximal end 176 of a surgical needle blank 174. In one embodiment, the second needle blank rotating device 204B includes a second rotatable disc 206B coupled with the second needle blank rotating device 204B and a second pin 208B mounted on the second rotatable disk 206B that engages the tail 178 for rotating the needle blank 174 about its longitudinal axis within the carrier strip 172.

The second grinding station 202B desirably includes a second grinding wheel 120B having a grinding surface 170B that is rotated by a second motor 220B having a second shaft 222B. The abrasive grinding surface 170B desirably includes ABN600 abrasive particles having an average size of about 20 microns bound to the grinding surface 170B by a nickel plated binding layer having a thickness of about 65% of the size of the 20 micron abrasive particles. The second grinding station 202B also desirably includes a second lubricator 230B adapted to apply a lubricant between the distal ends 180 of the needle blanks 174 and the grinding surface 170B of the second grinding wheel 160B.

In one embodiment, the second motor 220B rotates the second grinding wheel 160B and the distal ends 180 of the needle blanks 174 are abutted against the abrasive grinding surface 170B to form tapered points at the distal ends 180. The needle blanks are preferably rotated about their longitudinal axes during grinding. Simultaneously, a lubricant is sprayed onto the interface between the grinding surface and the distal end 180 of the needle blank 174. In one embodiment, the grinding wheel 170B desirably includes a V-shaped peripheral edge 170 including abrasive particles bound to the wheel 120 by a binding layer. The abrasive particles at the second grinding station 202B preferably have a size of about 20 microns. The binding material layer preferably has a thickness that is proximally 65% percent of the size of the abrasive particles.

In one embodiment, the surgical needle blanks 174 and the rotatable grinding wheels 120A, 120B are preferably moved with respect to each other during grinding. As the needle blanks 180 are turned about their longitudinal axes by the rotating devices 204A, 204B, the grinding surfaces 170A, 170B on the respective grinding wheels 120A, 120B grind the distal ends 180 of the needle blanks 174.

After the distal end 180 of the needle blank 174 is ground at the first grinding station 202A, the needle blank carrier 172 is advanced downstream toward the second grinding station 202B. The second grinding station 202A is generally similar to the first grinding station 202A with the exception of the size of the abrasive particles on the second grinding wheel 120B. In one embodiment, the second grinding wheel 120B preferably has abrasive particles having an average size of about 20 microns in diameter. The binding material layer on the second grinding wheel 120B preferably has a thickness that is about 65% of the average size of the abrasive particles on the second grinding wheel 160B, which is about 12.4 microns.

In the embodiment of FIG. 7, two grinding stations 202A and 202B are shown. In other embodiments, however, fewer or more grinding stations may be provided. For example, in one embodiment, a first grinding station may have a grinding wheel with abrasive particles having an average size of about 44 microns, a second grinding station may have a grinding wheel with abrasive particles having abrasive particles having an average size of about 36 microns, and a third grinding station may have a grinding wheel with abrasive particles having an average size of about 20 microns. In yet another embodiment, the first grinding station may have abrasive particles having an average size of about 44 microns, the second grinding station may have abrasive particles having an average size of about 36 microns, and the third grinding station may have abrasive particles having an average size of about 20 microns. The binding material layer at each station preferably has a thickness that is 65% of the size of the abrasive particles associated therewith.

The abrasive particles on the grinding stations preferably remove material at the distal ends of the surgical needle blanks to produce tapered points at the distal ends thereof. In one embodiment, the abrasive particles for grinding will typically be coarser in a first grinding station and finer in a second, or subsequent grinding station. In one embodiment, the needle blanks may be maintained in a fixed configuration in a carrier strip and the grinding wheels 120A, 120B may be moved orbitally about the distal ends of the needle blanks 174 for forming tapered points.

As used herein, the terminology "tapered point" is defined to mean that a distal end of a surgical needle or needle blank tapers from a maximum dimension to a distal minimum whereby the distal point may have a variety of radii ranging from a piercing point to the original diameter of the wire used to manufacture the surgical needle or the needle blank.

Figure 8A:
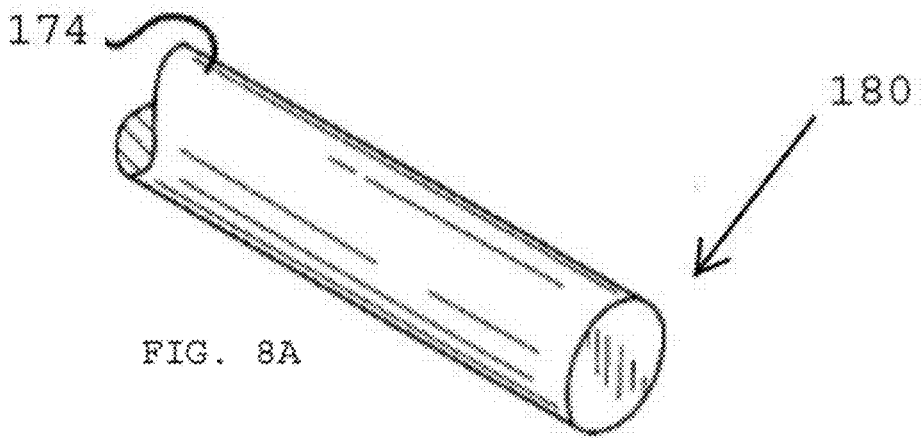
FIGS. 8A-8C show a method of making a tapered point at a distal end of a surgical needle, in accordance with one embodiment of the present invention.
Figure 8B:
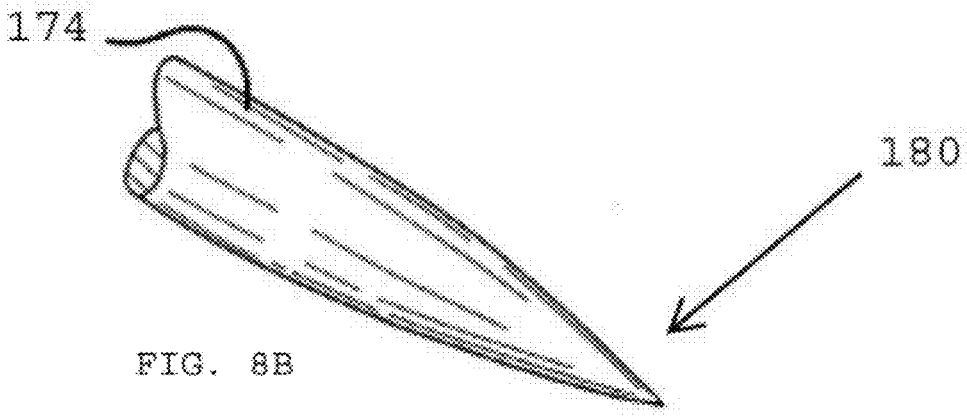
Figure 8C:
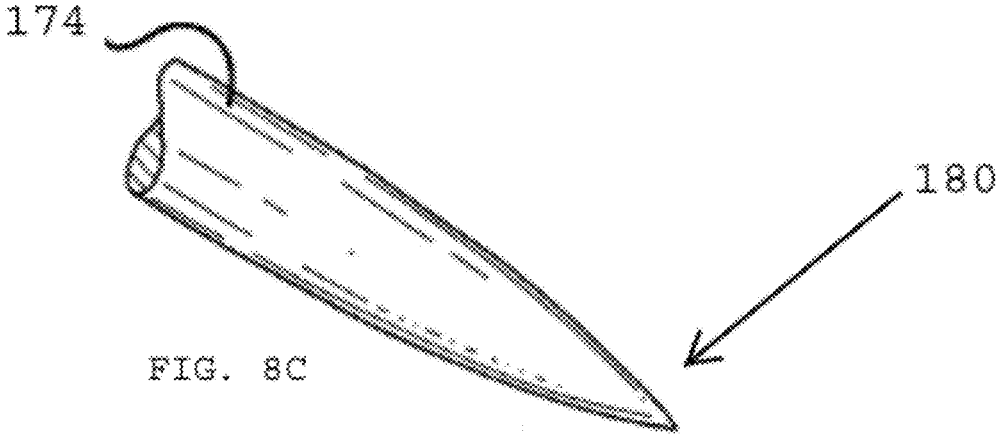

Referring to FIG. 8A, in one embodiment, a spool of wire is cut into a plurality of needle blanks 174 having a distal end 180 that lies within a plane that is substantially perpendicular to a longitudinal axis of the needle blank. Referring to FIG. 8B, the distal end 180 is preferably abutted against the rotating grinding wheel 120A of the first grinding station 202A (FIG. 7). Referring to FIG. 8C, the distal end 180 of the needle blank if desirably abutted against the second rotating grinding wheel 120B of the second grinding station 202B (FIG. 7). In one embodiment, after being ground at the first and second grinding stations 202A, 202B (FIG. 7), the distal end 180 of the needle blank 174 will have the configuration shown in FIG. 8C. In one embodiment, the grooved grinding surface 170 (FIG. 6C) desirably has a shape and/or contour that matches the final ground shape of the distal end 180 of the needle blank 174 shown in FIG. 8C.

FIG. 9 shows the results achieved when using grinding wheels and tools having different abrasive particles. The chart has a first column that identifies the type of abrasive material used on the grinding wheel, a second column that indicates the thickness of the binding material layer relative to the average size of the abrasive particles on a grinding wheel, a third column indicating if a lubricant is used during the grinding process, and a fourth column indicating how many needle blanks may be ground to a suitable tapered point prior to failure of the grinding wheel. As used herein in conjunction with describing if lubrication is used during the grinding process, the terminology "Yes-Inter. Mist" means that an intermittent mist of lubrication is used to cool the grinding surface of the grinding wheel, and the terminology "Yes" means that the grinding surface of the grinding tool and the distal end of the needle is flooded with a sufficient quantity of lubricant that is just short of a quantity of lubricant that will deflect the needle away from the grinding surface of the grinding wheel. Grinding wheel failure may be due to a number of causes including "gumming" and/or "capping" of the abrasive, and abrasive pull-out.

As shown in FIG. 9, when conventional grinding wheels, normally used for grinding stainless steel needles, are used on needles made from refractory metal alloys such as tungsten-rhenium alloys, the grinding wheel life is short. For example, when the grinding wheels and grinding belts use abrasive particles such as CBN and Diamond, the grinding wheels and belts will fail before grinding 8,000 needles. When using a lubricant on an intermittent basis during grinding, the life of the grinding wheel having CBN abrasive particles may be extended from 500 needles before failure to 4,000 needles.

Using a lubricant in conjunction with grinding wheels having ABN300, BZN, or ABN600 abrasive particles for grinding surgical needles made of tungsten-rhenium alloys will extend the life of the grinding wheel to about 12,000-38,000 needles. However, significant and unexpected results are obtained when increasing the thickness of the binding material layer from 50% to 65% of the average size of the abrasive particles. As shown in the chart, using a lubricant when grinding tungsten-rhenium needles with a grinding wheel having ABN600 abrasive particles and a binding material layer having a thickness of 50% relative to the size of the abrasive particles will grind 38,000 needles before failure. Using a lubricant when grinding tungsten-rhenium needles using a grinding wheel having ABN600 abrasive particles and a binding material layer having a thickness of 65% relative to the size of the abrasive particles will grind 73,000 needles before failure. Thus, increasing the thickness of the binding material layer from 50% to 65% relative to the size of the abrasive particles embedded therein will increase the life of the grinding wheel from 38,000 to 73,000 needles before failure.

In one embodiment, the grinding lubricant used during the grinding process is Azolla ZS 46 lubricating oil. The abrasive particles are preferably ABN600 abrasive particles that are plated onto a stainless steel wheel blank using a nickel plated binding material having a thickness that is 65% of the average size of the abrasive particles. The grinding wheel is preferably rotated at about 10,000 surface feet per minute for grinding the surgical needles.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A grinding tool for grinding surgical needles made of refractory metal alloys comprising:

a substrate having a surface;

a single layer of a binding material overlying said surface, said single layer of a binding material being in contact with said surface;

a plurality of abrasive particles embedded within said single binding material layer for projecting from said surface, wherein said abrasive particles are similarly sized and said single binding material layer has a uniform thickness that is about 65% of the size of said similarly sized abrasive particles, wherein said abrasive particles comprise cubic boron nitride particles having a cubo-octahedral morphology, and wherein said similarly sized abrasive particles have an average size of between about 20-44 microns.

2. The rotatable grinding wheel as claimed in claim 1, wherein said substrate comprises a grinding wheel having an outer edge including said surface.

3. The rotatable grinding wheel as claimed in claim 1, wherein said substrate comprises metal.

4. The rotatable grinding wheel as claimed in claim 2, wherein said outer edge of said substrate comprises a groove or V-shaped grinding surface adapted to receive ends of surgical needle blanks.

5. The rotatable grinding wheel as claimed in claim 1, wherein said similarly sized abrasive particles have a size of about 44 microns.

6. The rotatable grinding wheel as claimed in claim 1, wherein said similarly sized abrasive particles have a size of about 20 microns.

7. The rotatable grinding wheel as claimed in claim 1, wherein said cubic boron nitride abrasive particles having a cubo-octahedral morphology comprise ABN600 abrasive particles.

8. The rotatable grinding wheel as claimed in claim 1, wherein said binding material layer comprises a nickel alloy that is plated onto said surface.

9. A rotatable grinding wheel for grinding surgical needles made of refractory metal alloys comprising:

a rotatable wheel having a grinding surface;

a nickel binding layer overlying said grinding surface, wherein said nickel binding layer is in contact with said grinding surface of said rotatable wheel;

a plurality of abrasive particles embedded within said nickel binding layer, wherein said abrasive particles are similarly sized and said nickel binding layer has a thickness that is about 65% of said similarly sized abrasive particles, and wherein said abrasive particles comprise ABN600 abrasive particles having a size of about 20-44 microns.

10. The rotatable grinding wheel as claimed in claim 9, wherein said surgical needles comprise tungsten-rhenium alloys.

11. The rotatable grinding wheel as claimed in claim 9, wherein said nickel binding layer comprises a nickel alloy.

12. The rotatable grinding wheel as claimed in claim 9, further comprising a rotating element coupled with said rotatable wheel for rotating said grinding surface at about 10,000 surface feet per minute.

13. The rotatable grinding wheel as claimed in claim 9, further comprising a lubricator adapted to dispense a lubricant at an interface between said grinding surface and ends of said surgical needles abutted against said grinding surface.

14. The rotatable grinding wheel as claimed in claim 9, wherein said grinding surface comprises a groove or V-shaped grinding surface extending around an outer edge of said rotatable wheel.

15. A system for grinding surgical needles made of refractory metal alloys comprising:

a rotatable wheel having a grinding surface, a single layer of a binding material overlying and in contact with said grinding surface, and a plurality of abrasive particles embedded within said single binding material layer, wherein said abrasive particles are similarly sized and said single binding material layer has a thickness that is about 65% of said similarly sized abrasive particles;

a lubricating device adapted to apply a lubricant to said grinding surface; and a rotating element coupled with said rotatable wheel for rotating said grinding surface, wherein said abrasive particles comprise ABN600 abrasive particles having an average size of about 20-44 microns and said binding material layer comprises a nickel alloy.

16. The system as claimed in claim 15, wherein said nickel alloy binding material layer is plated onto said grinding surface, and said abrasive particles project from said binding material layer.

17. The system as claimed in claim 15, wherein said lubricating device is adapted to direct said lubricant toward an interface between said grinding surface and distal ends of said surgical needles.

18. The system as claimed in claim 15, wherein said lubricant is Azolla ZS 46 lubricating oil.

19. The system as claimed in claim 15, wherein said rotating element is adapted to rotate said grinding surface of said rotatable wheel at about 10,000 surface feet per minute.

* * * * *